US010927589B2

(12) United States Patent
Kashiwabara et al.

(10) Patent No.: US 10,927,589 B2
(45) Date of Patent: Feb. 23, 2021

(54) WINDOW REGULATOR

(71) Applicant: Johnan Manufacturing Inc., Nagano (JP)

(72) Inventors: Hideo Kashiwabara, Nagano (JP); Hiroki Shimizu, Nagano (JP); Yukihide Yamazaki, Nagano (JP); Wataru Murata, Nagano (JP)

(73) Assignee: JOHNAN MANUFACTURING INC., Nagano (JP)

( * ) Notice: Subject to any disclaimer, the term of this patent is extended or adjusted under 35 U.S.C. 154(b) by 87 days.

(21) Appl. No.: 16/298,548

(22) Filed: Mar. 11, 2019

(65) Prior Publication Data

US 2019/0292832 A1 Sep. 26, 2019

(30) Foreign Application Priority Data

Mar. 26, 2018 (JP) ..... JP2018-058634

(51) Int. Cl.
*E05F 11/48* (2006.01)
*E05F 15/689* (2015.01)
*E05D 15/16* (2006.01)

(52) U.S. Cl.
CPC ..... *E05F 15/689* (2015.01); *E05D 15/165* (2013.01); *E05Y 2900/55* (2013.01)

(58) Field of Classification Search
CPC ..... E05F 15/689; E05F 2900/55
USPC ..... 49/352
See application file for complete search history.

(56) References Cited

U.S. PATENT DOCUMENTS

| | | | | |
|---|---|---|---|---|
| 9,822,568 | B2 * | 11/2017 | Matsushita | E05F 15/689 |
| 10,287,811 | B1 * | 5/2019 | Arimoto | E05D 15/165 |
| 10,501,978 | B2 * | 12/2019 | Arimoto | E05F 15/689 |
| 10,577,849 | B2 * | 3/2020 | Arimoto | E05F 15/689 |
| 10,604,981 | B2 * | 3/2020 | Shiroma | E05F 11/486 |

(Continued)

FOREIGN PATENT DOCUMENTS

| | | | |
|---|---|---|---|
| JP | 3118237 | U | 12/2005 |
| JP | 2011-69059 | A | 4/2011 |

(Continued)

OTHER PUBLICATIONS

Office Action issued in the corresponding Japanese Patent Application No. 2018-058634 dated Feb. 25, 2020.

(Continued)

*Primary Examiner* — Jerry E Redman
(74) *Attorney, Agent, or Firm* — Roberts Calderon Safran & Cole P.C.

(57) ABSTRACT

A window regulator includes a metal guide rail provided along an ascending/descending direction of a window of a vehicle, a carrier plate that slides on the guide rail and moves together with the window, a drum rotationally driven by a motor, a cable that is routed between the drum and the carrier plate via a direction changing member provided at an upper end of the guide rail and pulls the carrier plate, and a cable support that supports the cable between the drum and the direction changing member. The cable support includes a resin slide member allowing the cable to slide thereon and an attached-member receiving portion to which the slide member is attached. The attached-member receiving portion is integrated with the guide rail.

6 Claims, 10 Drawing Sheets

(56) References Cited

U.S. PATENT DOCUMENTS

| | | | | |
|---|---|---|---|---|
| 2002/0020116 | A1* | 2/2002 | Arquevaux | E05F 11/485 49/349 |
| 2008/0005971 | A1* | 1/2008 | Dickie | E05F 15/689 49/349 |
| 2014/0268273 | A1 | 9/2014 | Brosnihan et al. | |
| 2017/0268273 | A1* | 9/2017 | Matsushita | E05F 11/382 |
| 2019/0186188 | A1* | 6/2019 | Arimoto | E05F 15/689 |

FOREIGN PATENT DOCUMENTS

| | | | |
|---|---|---|---|
| JP | 2013-96127 | A | 5/2013 |
| JP | 2014-177838 | A | 9/2014 |

OTHER PUBLICATIONS

Office Action issued in the corresponding Chinese Patent Application No. 2019-10227964.2 dated Jul. 31, 2020.

* cited by examiner

WINDOW REGULATOR

CROSS-REFERENCE TO RELATED APPLICATIONS

The present application is based on Japanese patent application No. 2018-058634 filed on Mar. 26, 2018, the entire contents of which are incorporated herein by reference.

BACKGROUND OF THE INVENTION

1. Field of the Invention

The invention relates to a window regulator.

2. Description of the Related Art

A window regulator is known which is provided with a curved guide rail fixed to a door panel of a vehicle, a carrier plate sliding on and guided by the guide rail, cables for pulling the carrier plate, a drum rotationally driven by a motor and holding a portion of the cables wound therearound, and a guide member provided between two ends of the guide rail to slidably support the cables routed between the drum and a pulley (see, e.g., Japanese utility model registration No. 3118237).

The guide member has a plate-shaped body extending in a direction intersecting a longitudinal direction of the guide rail and a columnar body which is removably attached to the plate-shaped body and has an insertion hole for inserting the cables.

SUMMARY OF THE INVENTION

In manufacturing the window regulator of Japanese utility model registration No. 3118237, it is necessary to fix the guide member to the guide rail by a fixing means such as welding or a rivet. This hinders the reduction of manufacturing cost.

It is an object of the invention to provide a window regulator with a reduced manufacturing cost.

According to an embodiment of the invention, a window regulator comprises:

a metal guide rail provided along an ascending/descending direction of a window of a vehicle;

a carrier plate that slides on the guide rail and moves together with the window;

a drum rotationally driven by a motor;

a cable that is routed between the drum and the carrier plate via a direction changing member provided at an upper end of the guide rail and pulls the carrier plate; and a cable support that supports the cable between the drum and the direction changing member, wherein the cable support comprises a resin slide member allowing the cable to slide thereon and an attached-member receiving portion to which the slide member is attached, and wherein the attached-member receiving portion is integrated with the guide rail.

EFFECTS OF THE INVENTION

According to an embodiment of the invention, a window regulator with a reduced manufacturing cost can be provided.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Summary of the Embodiments

Figure 1:
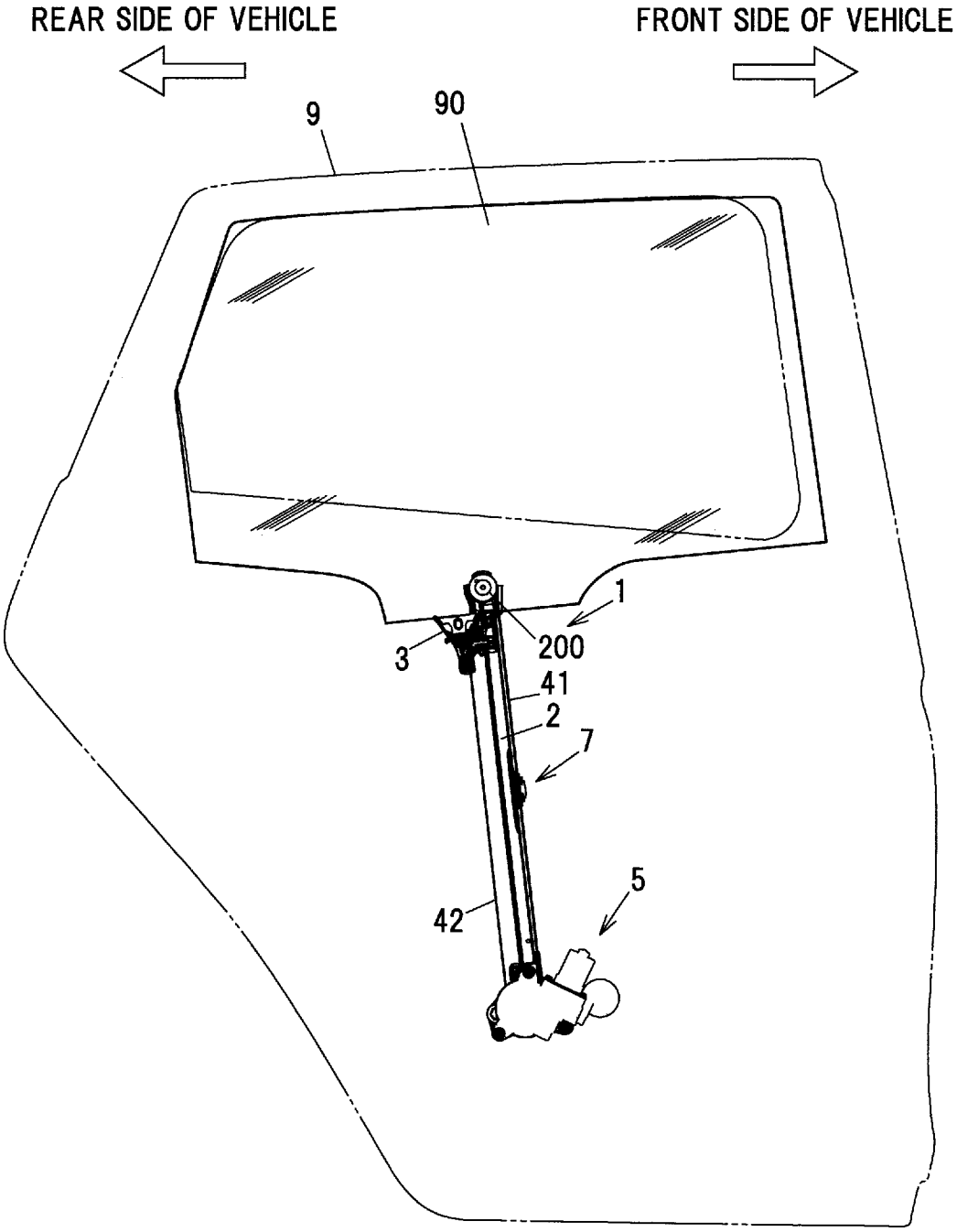
FIG. 1 is a general schematic diagram illustrating a window regulator in the first embodiment of the present invention and a vehicle door mounting the window regulator.

A window regulator 1 in the embodiments is provided with a metal guide rail 2 provided along an ascending/descending direction of a window 90 of a vehicle, a carrier plate 3 that slides on the guide rail 2 and moves together with the window 90, a drum 51 rotationally driven by a motor 50, an ascending-side cable 41 that is routed between the drum 51 and the carrier plate 3 via a pulley 200 as a direction changing member provided at an upper end of the guide rail 2 and pulls the carrier plate 3, and a cable support 7 that supports the ascending-side cable 41 between the drum 51 and the pulley 200, wherein the cable support 7 comprises a resin slide member 6 allowing the ascending-side cable 41 to slide thereon and an attached-member receiving portion 24 to which the slide member 6 is attached, and the attached-member receiving portion 24 is integrated with the guide rail 2.

In the window regulator 1, the attached-member receiving portion 24 serving as part of the cable support 7 is integrated with the guide rail 2. Thus, the manufacturing cost of the window regulator 1 can be reduced as compared to when the cable support 7 and the guide rail 2 are provided separately.

First Embodiment

The window regulator 1 in the first embodiment is a device for raising and lowering the window 90 on a door 9 of, e.g., an automobile and is installed on a door panel of the automobile.

General Configuration of the Window Regulator 1

Figure 2:
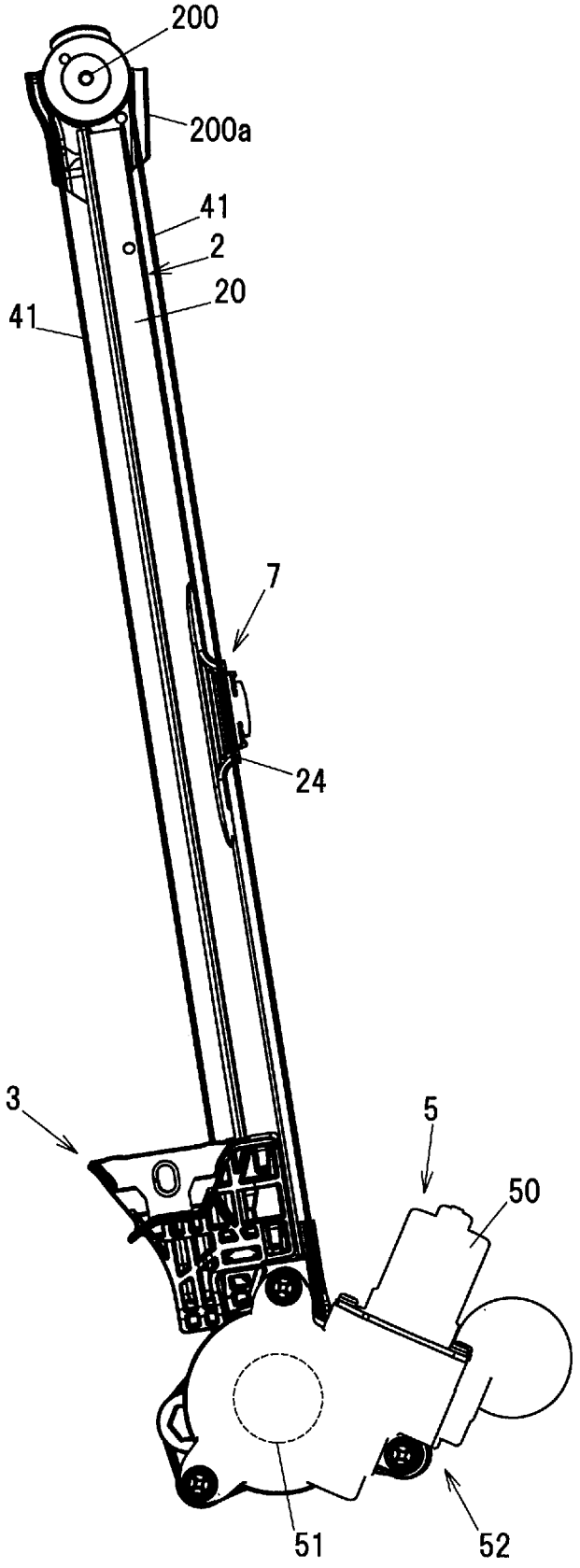
FIG. 2 is a plan view showing a configuration of the window regulator of the first embodiment.

FIG. 1 is a general schematic diagram illustrating the window regulator 1 in the first embodiment and the door 9 of a vehicle mounting the window regulator 1. FIG. 2 is an overall view showing a configuration of the window regulator 1. In FIG. 1, the window 90 is in a fully-closed state, and the door 9 and a window frame are indicated by dash-dot-dot lines. In addition, in FIG. 1, the left side of the paper is the rear side in the vehicle longitudinal direction and the right side of the paper is the front side in the vehicle longitudinal direction.

As shown in FIGS. 1 and 2, the window regulator 1 is generally composed of the guide rail 2 which is housed in a door panel (not shown) provided on the door 9 of the vehicle and is arranged along an ascending/descending direction of the window 90, the carrier plate 3 which slides on the guide rail 2 and moves together with the window 90, the ascending-side cable 41 and a descending-side cable 42 which pull the carrier plate 3, and a drive unit 5 which generates a driving force for taking up and feeding out the ascending-side cable 41 and the descending-side cable 42.

Configuration of the Guide Rail 2

The guide rail 2 is a metal member formed by bending a long metal plate at a predetermined curvature and is arranged so as to tilt to the rear side in the vehicle longitudinal direction with respect to the door 9. The guide rail 2 integrally has a flat plate portion 20 extending in a longitudinal direction thereof, first and second side plate portions 21 and 22 rising upright from both edges of the flat plate portion 20 which are the edges in a width direction orthogonal to the longitudinal direction thereof, and a flange portion 23 projecting from an end of the second side plate portion 22 toward the side opposite to the flat plate portion 20 (see FIG. 5A which is described later). In FIG. 2, the first and second side plate portions 21 and 22 protrude toward the near side (reader's side) of the paper. The second side plate portion 22 slidably supports the carrier plate 3.

Configuration of the Carrier Plate 3

The carrier plate 3 is a plate-shaped member formed of, e.g., a resin such as polyacetal. The carrier plate 3 has an ascending-side cable end housing portion 31 and a descending-side cable end housing portion 32. The ascending-side cable end housing portion 31 houses an ascending-side cable end (not shown) formed at an end of the ascending-side cable 41. The descending-side cable end housing portion 32 houses a descending-side cable end (not shown) formed at an end of the descending-side cable 42.

Configuration of the Ascending-Side Cable 41 and the Descending-Side Cable 42

The ascending-side cable 41 is coupled to the carrier plate 3 at one end, turns at the pulley 200 provided at the top end of the guide rail 2, and is coupled to the drum 51 of the drive unit 5 (described later) at the other end. The descending-side cable 42 is coupled to the carrier plate 3 at one end and is coupled to the drum 51 at the other end. The pulley 200 is shaft-supported by a pulley bracket 200*a* which is fixed to an upper end of the guide rail 2. The pulley bracket 200*a* is fixed to a door panel by a bolt (not shown).

The ascending-side cable 41 and the descending-side cable 42 are routed so as not to overlap the guide rail 2 when viewed in a direction along a rotational axis of the drum 51.

Configuration of the Drive Unit 5

The drive unit 5 has the motor 50 with reducer, the cylindrical drum 51 (indicated by a dashed line in FIG. 2) and a housing 52. The drum 51 is rotationally driven by the motor 50 and rotates to take up and feed out the ascending-side cable 41 and the descending-side cable 42. The housing 52 is provided at a lower end of the guide rail 2, and is composed of a motor housing 520 holding the motor 50 and a drum housing 521 fixed to the motor housing 520 and accommodating the drum 51.

The motor 50 is held by the motor housing 520 and is inclined by a predetermined angle about the rotational axis of the drum 51. The reducer constructed from a worm wheel, etc., is coupled to and meshes with the output shaft of the motor 50. The reducer is housed in the motor housing 520.

Cable Support

Figure 3A:
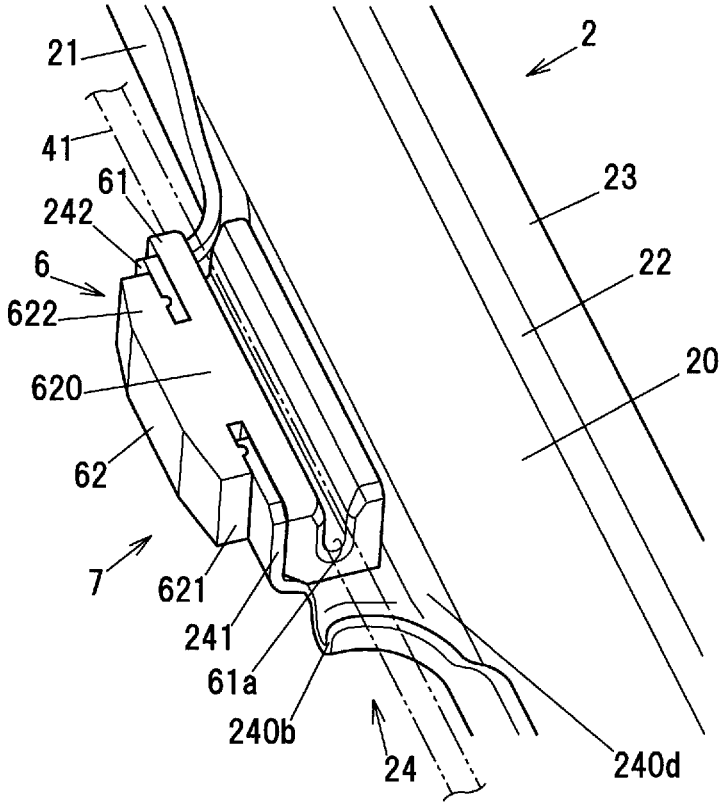
FIG. 3A is a perspective view showing a configuration of a cable support in the first embodiment.
Figure 3B:
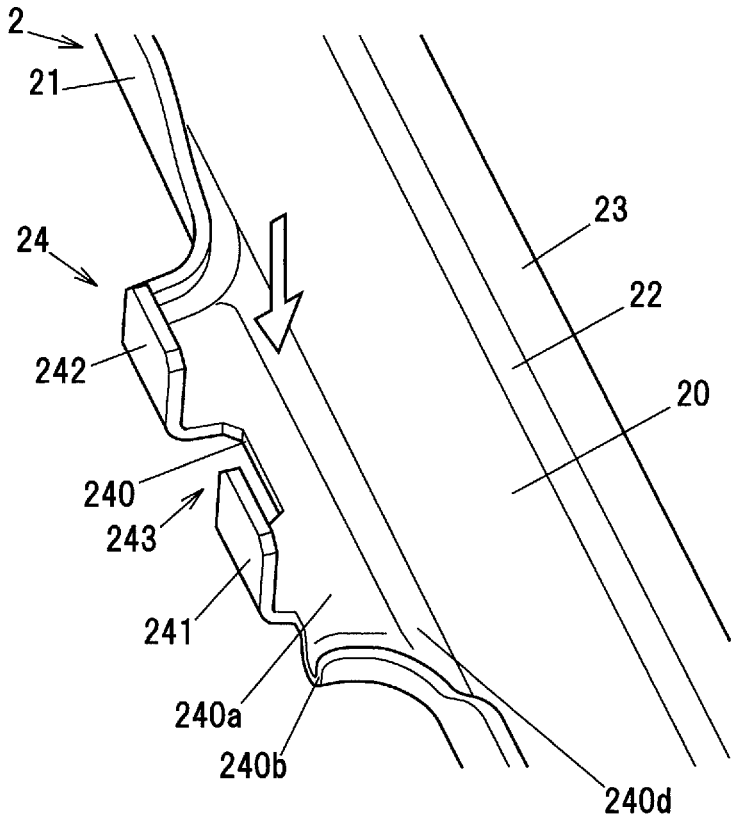
FIG. 3B is a perspective view when showing the cable support a slide member is detached.

FIG. 3A is a perspective view showing a configuration of the cable support 7 in the first embodiment and FIG. 3B is a perspective view showing the cable support 7 when the slide member 6 is detached. In FIG. 3A, the ascending-side cable 41 is indicated by a dash-dot-dot line.

The cable support 7 is provided between the upper and lower ends of the guide rail 2 and supports the ascending-side cable 41 routed between the drum 51 and the pulley 200 in the manner shown in FIG. 3A. This configuration prevents noise caused by vibration of the ascending-side cable 41 due to, e.g., an impact generated by closing the door.

The cable support 7 includes the resin slide member 6 allowing the ascending-side cable 41 to slide thereon and the attached-member receiving portion 24 to which the slide member 6 is attached, and the attached-member receiving portion 24 is integrated with the guide rail 2. This configuration eliminates the need for, e.g., work described in Japanese utility model registration No. 3118237 and carried out to fix the plate-shaped body of the guide member to the guide rail by welding, etc., and also eliminates the need of a component corresponding to the plate-shaped body. Thus, it is possible to reduce the manufacturing cost and the number of components.

The attached-member receiving portion 24 is formed by, e.g., pressing a metal plate. The slide member 6 is arranged removable from the attached-member receiving portion 24. In the first embodiment, an attachment direction of attaching the slide member 6 to the attached-member receiving portion 24 is a direction along a vehicle width direction (an arrow direction shown in FIG. 3B). The slide member 6 may alternatively be integrally molded with the attached-member receiving portion 24 of the guide rail 2.

Attached-Member Receiving Portion of the Guide Rail

Figure 4A:
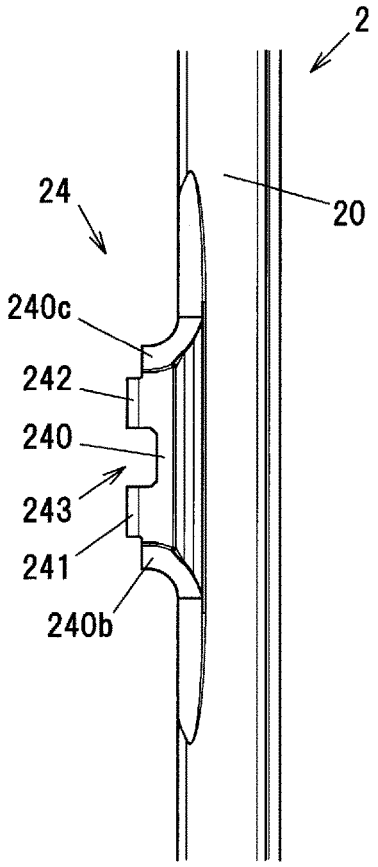
FIG. 4A is a back view showing a guide rail.
Figure 4B:
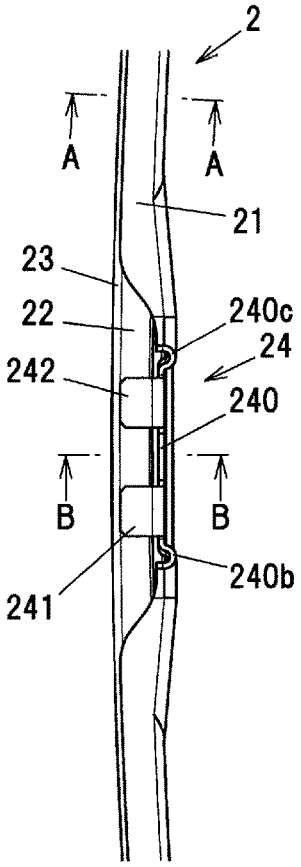
FIG. 4B is a right side view of the guide rail.
Figure 4C:
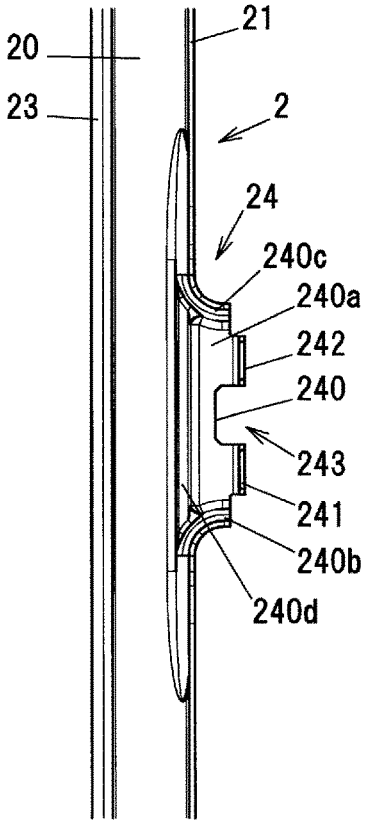
FIG. 4C is a front view of the guide rail.
Figure 5A:
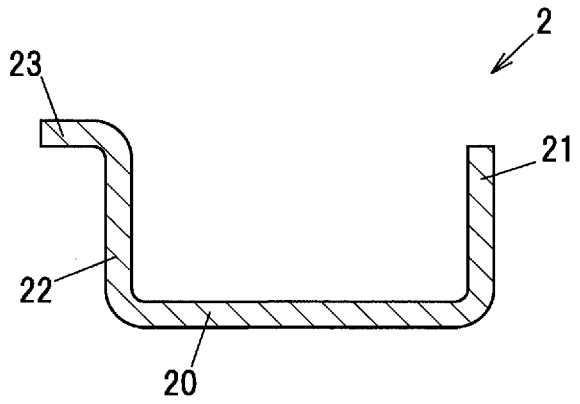
FIG. 5A is a cross sectional view taken along line A-A in FIG. 4B.
Figure 5B:
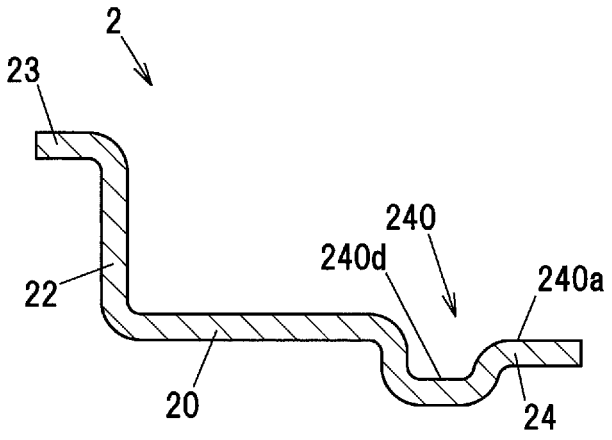
FIG. 5B is a cross sectional view taken along line B-B in FIG. 4B.

FIG. 4A is a back view showing a guide rail, FIG. 4B is a right side view and FIG. 4C is a front view. FIG. 5A is a cross sectional view taken along line A-A in FIG. 4B, and FIG. 5B is a cross sectional view taken along line B-B in FIG. 4B.

As shown in FIGS. 3B and 4A to 4C, the attached-member receiving portion 24 of the guide rail 2 has a plate-shaped mounting portion 240 and plate-shaped first and second fitting portions 241 and 242. The mounting portion 240 projects from an end portion of the flat plate portion 20 in a direction orthogonal to the longitudinal direction of the guide rail 2 (projects outward in a lateral direction of the guide rail 2). The first and second fitting portions 241 and 242 are formed at the outer edge (an end portion located outermost in the lateral direction) of the mounting portion 240 so as to rise upright in the rising direction of the first and second side plate portions 21 and 22. The mounting portion 240 has a mounting surface 240*a* on which the slide member 6 is mounted. The attached-member receiving portion 24 is provided on one of the first and second side plate portions 21 and 22 which is not the side plate portion slidably supporting the carrier plate 3. In other words, in the first embodiment, the attached-member receiving portion 24 is provided at the end portion of the guide rail 2 on the first side plate portion 21 side.

The attached-member receiving portion 24 has first and second curved portions 240*b* and 240*c* which are respectively arranged at both end portions in the longitudinal direction of the mounting portion 240 and are formed to curve while protruding in the plate thickness direction of the mounting portion 240. As shown in FIG. 4B, the first and second curved portions 240*b* and 240*c* have an arc shape when viewed in the lateral direction of the guide rail 2. Due to the presence of the first and second curved portions 240*b* and 240*c*, a force in a direction to push the slide member 6 against the mounting surface 240*a* is applied to the attached-member receiving portion 24 by tension of the ascending-side cable 41 during when the window regulator 1 is operating. The first and second curved portions 240*b* and 240*c* also provide additional strength against such force.

The mounting portion 240 also has a cutout 243 which is recessed in the lateral direction of the guide rail 2 from the first side plate portion 21 side toward the second side plate portion 22. The cutout 243 is provided between the first and second fitting portions 241 and 242. The cutout 243 is formed as an insertion hole which allows a worker to insert a finger at the time of removing the slide member 6 and to push out the slide member 6 in a direction orthogonal to the mounting surface 240*a*.

As shown in FIG. 5B, a recessed portion 240*d* depressed from the flat plate portion 20 is formed on the mounting portion 240 of the attached-member receiving portion 24 at an edge on the flat plate portion 20 side. The recessed portion 240*d* extending along the longitudinal direction of the guide rail 2 is formed on the guide rail 2 in a region in which the first side plate portion 21 is not formed. In the first embodiment, the mounting surface 240*a* is provided at a position slightly shifted toward the opposite side to the rising direction of the first and second side plate portions 21 and 22.

As shown in FIG. 2, the attached-member receiving portion 24 serving as part of the cable support 7 is provided at a longitudinal middle portion of the guide rail 2. Due to this configuration, the guide rail 2 in the first embodiment after being manufactured can be used for any of right and left doors simply by turning the guide rail 2 upside down. This allows the components to be commonly used for right and left door window regulators, contributing to the manufacturing cost reduction.

Slide Member

Figure 6A:
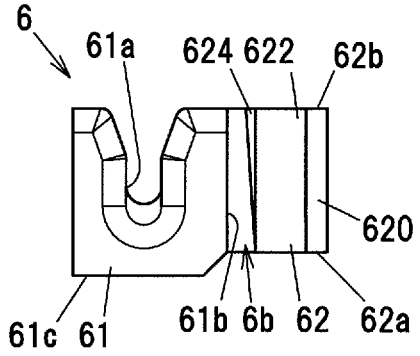
FIG. 6A is a top view showing a configuration of the slide member.
Figure 6B:
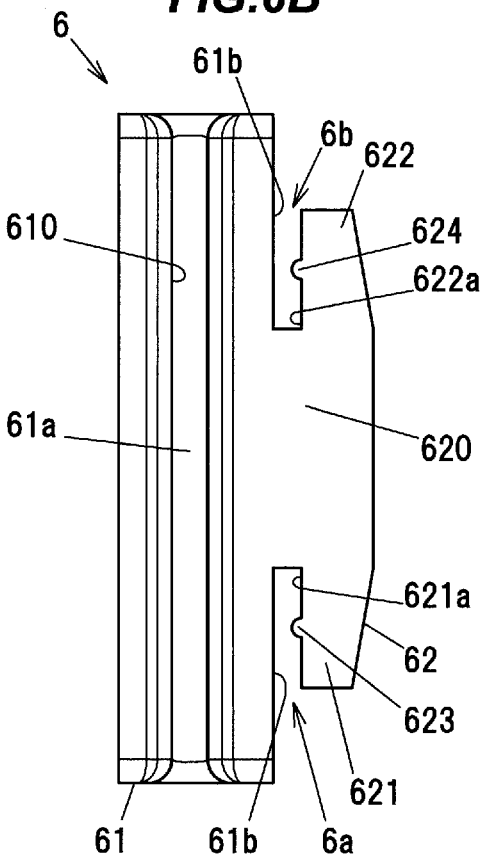
FIG. 6B is a front view of the slide member.
Figure 6C:
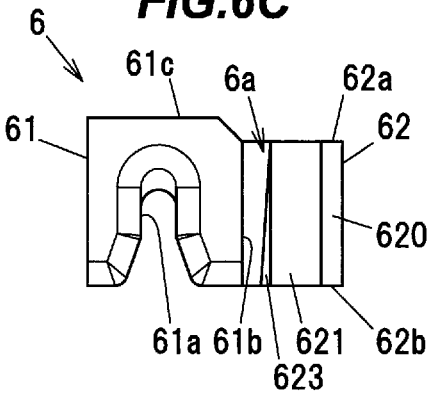
FIG. 6C is a bottom view of the slide member.

FIG. 6A is a top view showing a configuration of the slide member, FIG. 6B is a front view and FIG. 6C is a bottom view.

The slide member 6 integrally has a slide portion 61 having a sliding groove 61*a* and an attachment portion 62 used for attachment to the attached-member receiving portion 24 of the guide rail 2.

The slide portion 61 has a substantially rectangular parallelepiped shape and holds the ascending-side cable 41 which is inserted through a slit 610 extending in the longitudinal direction of the slide portion 61 (an extending direction of the ascending-side cable 41 shown in FIG. 3A). A bottom surface 61*c* of the slide portion 61 is to be in contact with the mounting surface 240*a* of the mounting portion 240.

The attachment portion 62 has a main body 620 joined to a side surface 61*b* of the slide portion 61 and first and second projecting portions 621 and 622 projecting from both end portions of the main body 620 in the longitudinal direction of the slide portion 61.

The first and second projecting portions 621 and 622 face the slide portion 61 with a gap interposed therebetween. A first protruding portion 623 is formed on the first projecting portion 621 and protrudes from a first facing surface 621*a* which faces the side surface 61*b* of the slide portion 61. Likewise, a second protruding portion 624 is formed on the second projecting portion 622 and protrudes from a second facing surface 622*a* which faces the side surface 61*b* of the slide portion 61. The first and second protruding portions 623 and 624 are squashed when the first and second fitting portions 241 and 242 of the attached-member receiving portion 24 of the guide rail 2 are fitted to first and second fitting grooves 6*a* and 6*b* (described later), allowing the slide member 6 to be firmly fitted to the attached-member receiving portion 24.

As shown in FIGS. 6A and 6C, the protruding length of the first and second protruding portions 623 and 624 increases from a bottom surface 62*a* toward an upper surface 62*b* of the attachment portion 62. In other words, the first and second protruding portions 623 and 624 when viewed in the longitudinal direction of the slide portion 61 have a shape with an inclined surface inside the first/second fitting groove 6*a*/6*b*. When the slide member 6 is attached to the attached-member receiving portion 24 of the guide rail 2, it is possible to smoothly slide the first and second fitting portions 241 and 242 of the attached-member receiving portion 24 of the guide rail 2 on the inclined surfaces of the first and second protruding portions 623 and 624 of the slide member 6. That is, it is easy to attach the slide member 6 to the attached-member receiving portion 24 of the guide rail 2.

A space formed between the side surface 61*b* of the slide portion 61 and the first facing surface 621*a* of the attachment portion 62 serves as the first fitting groove 6*a* to which the first fitting portion 241 of the attached-member receiving portion 24 of the guide rail 2 is fitted. Likewise, a space formed between the side surface 61*b* of the slide portion 61 and the second facing surface 622*a* of the attachment portion 62 serves as the second fitting groove 6*b* to which the second fitting portion 242 of the attached-member receiving portion 24 of the guide rail 2 is fitted.

In the first embodiment, since the attached-member receiving portion 24 serving as part of the cable support 7 is integrated with the guide rail 2 as described above, it is possible to reduce the manufacturing cost.

In addition, in the first embodiment, since the attached-member receiving portion 24 is arranged at a longitudinal middle portion of the guide rail 2, it is possible to commonly use the components for right and left door window regulators, contributing to the manufacturing cost reduction.

Since the first and second fitting grooves 6*a* and 6*b* for fitting the first and second fitting portions 241 and 242 of the attached-member receiving portion 24 of the guide rail 2 are formed on the slide member 6, it is easy to attach the slide member 6 to the guide rail 2.

Since the first and second curved portions 240*b* and 240*c* are formed on the attached-member receiving portion 24 of the guide rail 2, rigidity of the attached-member receiving portion 24 is enhanced.

In the meantime, when manufacturing the window regulator described in Japanese utility model registration No. 3118237, it is necessary to fix the guide member (the plate-shaped body) to the guide rail by a fixing means such as welding. Therefore, a welding mark is sometimes left on the guide rail. In such a case, the carrier plate may come into contact with the welding mark when the carrier plate 3 slides on the guide rail 2. In contrast, in the first embodiment, welding work is not required since the attached-member receiving portion 24 is integrated with the guide rail 2, and the problem of contact between the carrier plate and the welding mark as mentioned above does not occur. That is, the guide rail in the first embodiment contributes to improvement in stability of the carrier plate.

Second Embodiment

Next, a window regulator in the second embodiment will be described in reference to FIGS. 7 to 9. The window regulator in the second embodiment has a cable support 7A of which configuration is different from the configuration of the cable support 7 of the window regulator in the first embodiment.

Figure 7A:
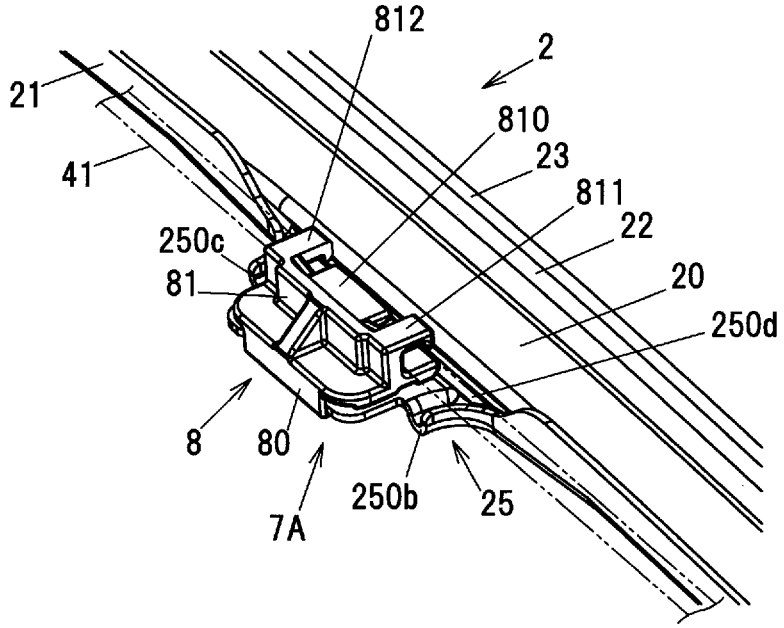
FIG. 7A is a perspective view showing a configuration of a cable support in the second embodiment.
Figure 7B:
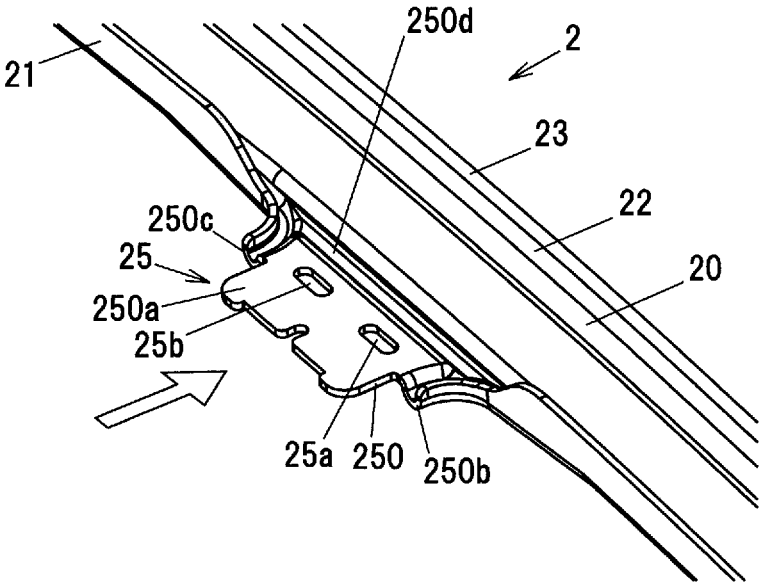
FIG. 7B is a perspective view showing the cable support when a slide member is detached.

The cable support 7A in the second embodiment will be described in reference to FIG. 7. FIG. 7A is a perspective view showing a configuration of the cable support 7A in the second embodiment and FIG. 7B is a perspective view showing the cable support 7A when a slide member 8 is detached.

Cable Support

The cable support 7A is provided between the upper and lower ends of the guide rail 2 and supports the ascending-side cable 41 (indicated by a dash-dot-dot line) routed between the drum 51 and the pulley 200 in the manner shown in FIG. 7A. This configuration prevents noise caused by vibration of the ascending-side cable 41 due to, e.g., an impact generated by closing the door.

The cable support 7A includes the resin slide member 8 allowing the ascending-side cable 41 to slide thereon and an attached-member receiving portion 25 to which the slide member 8 is attached, and the attached-member receiving portion 25 is integrated with the guide rail 2. This configuration eliminates the need for, e.g., work described in Japanese utility model registration No. 3118237 and carried out to fix the plate-shaped body of the guide member to the guide rail by welding, etc., and also eliminates the need of a component corresponding to the plate-shaped body. Thus, it is possible to reduce the manufacturing cost and the number of components.

The attached-member receiving portion 25 is formed by, e.g., pressing a metal plate. The slide member 8 is arranged removable from the attached-member receiving portion 25. In the second embodiment, an attachment direction of attaching the slide member 8 to the attached-member receiving portion 25 is a direction along the vehicle longitudinal direction (an arrow direction shown in FIG. 7B). The slide member 8 may alternatively be integrally molded with the attached-member receiving portion 25 of the guide rail 2.

Attached-Member Receiving Portion of the Guide Rail

Figure 8A:
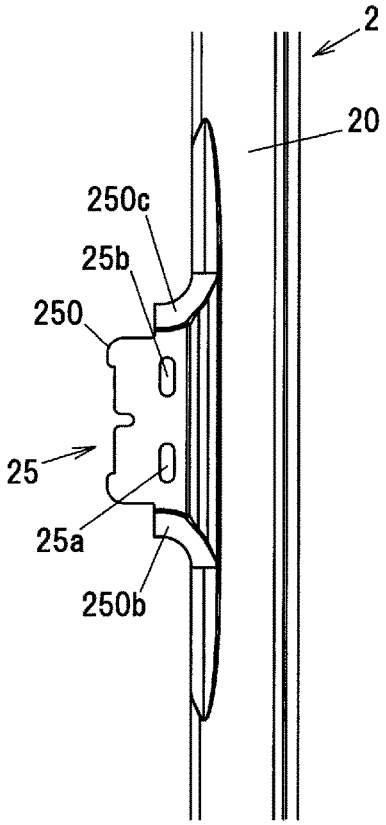
FIG. 8A is a back view showing a guide rail in the second embodiment.
Figure 8B:
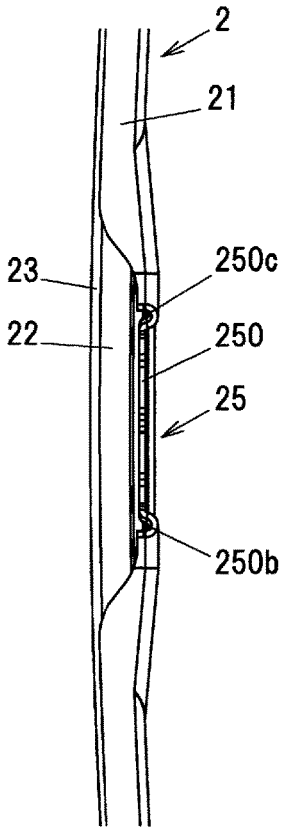
FIG. 8B is a right side view of the guide rail.
Figure 8C:
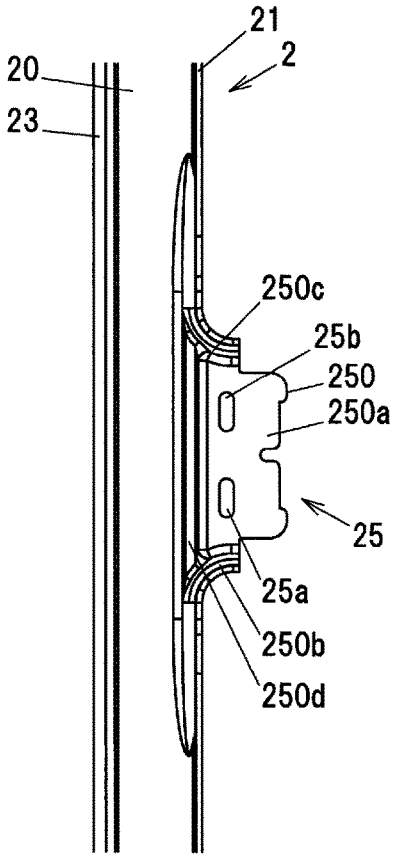
FIG. 8C is a front view of the guide rail.
Figure 9A:
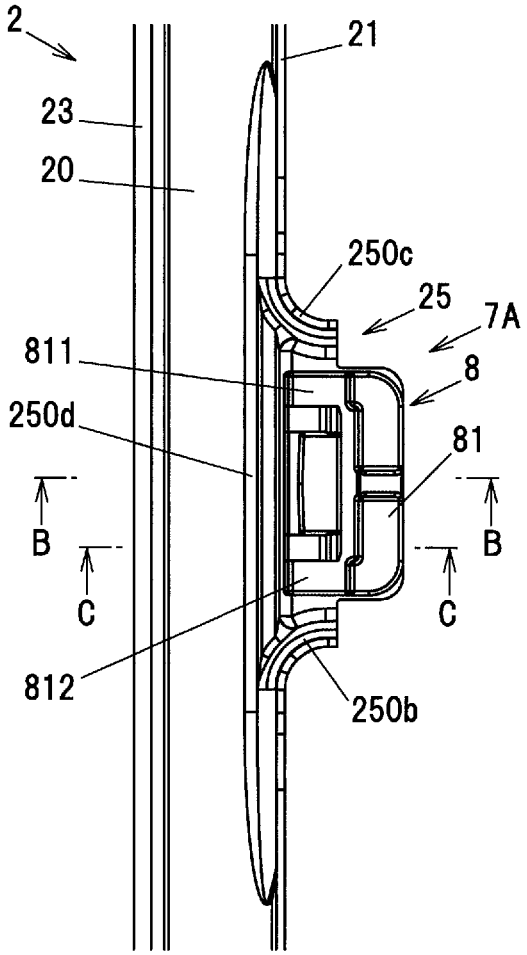
FIG. 9A is a plane view when the slide member is attached to the cable support in the second embodiment.
Figure 9B:
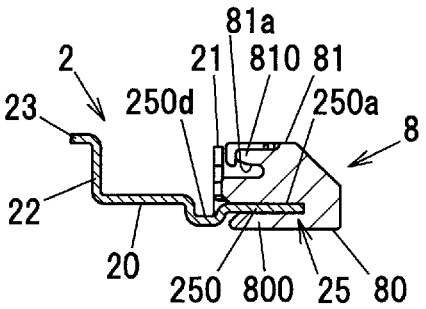
FIG. 9B is a cross sectional view taken along line B-B in FIG. 9A.
Figure 9C:
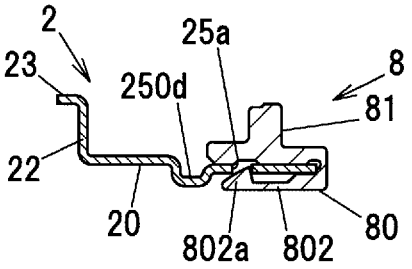
FIG. 9C is a cross sectional view taken along line C-C in FIG. 9A.

FIG. 8A is a back view showing a guide rail, FIG. 8B is a right side view and FIG. 8C is a front view. FIG. 9A is a plane view when the slide member 8 is attached to the cable support 7A in the second embodiment, FIG. 9B is a cross sectional view taken along line B-B in FIG. 9A, and FIG. 9C is a cross sectional view taken along line C-C in FIG. 9A.

As shown in FIGS. 8A to 8C, the attached-member receiving portion 25 of the guide rail 2 has a plate-shaped mounting portion 250 which projects from an end portion of the flat plate portion 20 in a direction orthogonal to the longitudinal direction of the guide rail 2 (projects outward in the lateral direction of the guide rail 2). The mounting portion 250 has a mounting surface 250*a* on which the slide member 8 is mounted. The attached-member receiving portion 25 is provided on one of the first and second side plate portions 21 and 22 which is not the side plate portion slidably supporting the carrier plate 3. In other words, in the second embodiment, the attached-member receiving portion 25 is provided at the end portion of the guide rail 2 on the first side plate portion 21 side.

The attached-member receiving portion 25 has first and second curved portions 250*b* and 250*c* which are respectively arranged at both end portions in the longitudinal direction of the mounting portion 250 and are formed to curve while protruding in the plate thickness direction of the mounting portion 250. As shown in FIG. 8B, the first and second curved portions 250*b* and 250*c* have an arc shape when viewed in the lateral direction of the guide rail 2.

Due to the presence of the first and second curved portions 250*b* and 250*c*, a force in a direction to push the slide member 8 against the mounting surface 250*a* is applied to the attached-member receiving portion 25 by tension of the ascending-side cable 41 during when the window regulator 1 is operating. The first and second curved portions 250*b* and 250*c* also provide additional strength against such force.

The mounting portion 250 also has first and second locking holes 25*a* and 25*b* which penetrate the mounting portion 250 in the plate thickness direction. The first and second locking holes 25*a* and 25*b* respectively engage first and second locking claws 801*a* and 802*a* of the slide member 8 (described later).

As shown in FIG. 9A to 9C, a recessed portion 250*d* depressed from the flat plate portion 20 is formed on the mounting portion 250 of the attached-member receiving portion 25. The recessed portion 250*d* extending along the longitudinal direction of the guide rail 2 is formed on the guide rail 2 in a region in which the first side plate portion 21 is not formed.

The attached-member receiving portion 25 serving as part of the cable support 7A is provided at a longitudinal middle portion of the guide rail 2. Due to this configuration, the guide rail 2 in the second embodiment after being manufactured can be used for any of right and left doors simply by turning the guide rail 2 upside down. This allows the components to be commonly used for right and left door window regulators, contributing to the manufacturing cost reduction.

Slide Member

Figure 10A:
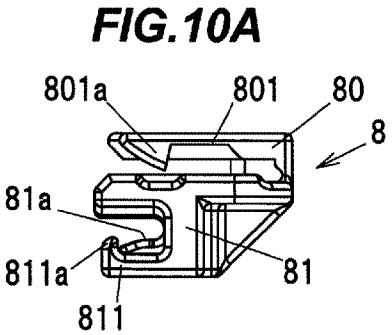
FIGS. 10A to 10F are plan views showing a configuration of the slide member in the second embodiment.
Figure 10B:
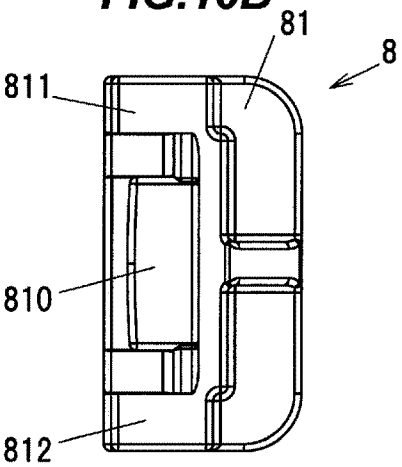
Figure 10E:
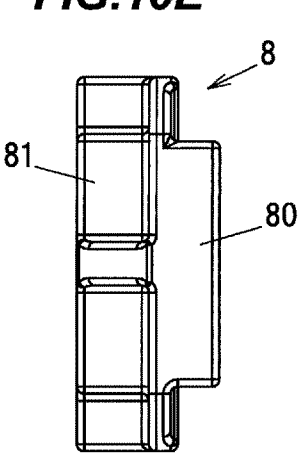
Figure 10F:
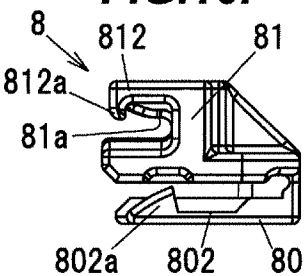
Figure 10D:
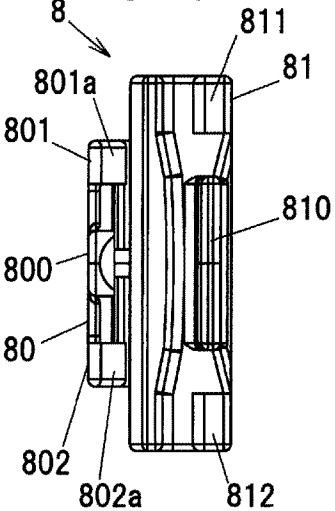
Figure 10C:
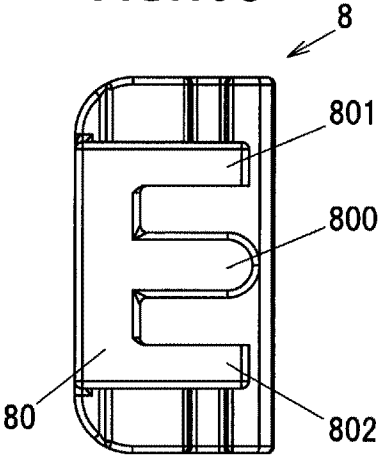

FIG. 10A is a top view showing a configuration of the slide member, FIG. 10B is a front view, FIG. 10C is back view, FIG. 10D is a left side view, FIG. 10E is a right side view, and FIG. 10F is a bottom view.

The slide member 8 is generally formed in a substantially rectangular parallelepiped shape and integrally has an attachment portion 80 used for attachment to the attached-member receiving portion 25 of the guide rail 2 and a slide portion 81 on which the ascending-side cable 41 slides.

The attachment portion 80 has first and second locking portions 801, 802 and a support portion 800. The first and second locking portions 801 and 802 are arranged with a gap from the slide portion 81 and lock the attached-member receiving portion 25. The support portion 800 is arranged between the first and second locking portions 801 and 802 and supports the attached-member receiving portion 25.

The first and second locking portions 801 and 802 respectively have the first and second locking claws 801*a* and 802*a* which engage the first and second locking holes 25*a* and 25*b* on the mounting portion 250 of the attached-member receiving portion 25. This increases attachment strength of the slide member 8 to the guide rail 2.

The slide portion 81 has first and second hooks 811 and 812. First and second slide claws 811*a* and 812*a* for grabbing and holding the ascending-side cable 41 are respectively provided on the first and second hooks 811 and 812.

The ascending-side cable 41 is inserted over the first and second slide claws 811*a* and 812*a* and is housed in a sliding groove 81*a* which is located inside beyond the first and second slide claws 811*a* and 812*a*. This configuration prevents noise caused by vibration of the ascending-side cable 41 due to, e.g., an impact generated by closing the door. The first and second hooks 811 and 812 also prevent the ascending-side cable 41 from slipping out toward the near side (reader's side) of the paper of FIG. 2.

In the state that the slide member 8 is attached to the attached-member receiving portion 25, the mounting portion 250 of the attached-member receiving portion 25 is sandwiched in between the attachment portion 80 and the slide portion 81 of the slide member 8, and at the same time, the first and second locking claws 801*a* and 802*a* of the slide member 8 engage the first and second locking holes 25*a* and 25*b* of the mounting portion 250, as shown in FIGS. 9B and 9C. The slide member 8 is thereby fixed to the guide rail 2.

Since the window regulator 1 in the second embodiment is configured that the attached-member receiving portion 25 serving as part of the cable support 7A is integrated with the guide rail 2, it is possible to reduce the manufacturing cost in the same manner as the first embodiment.

Although the embodiments of the invention have been described, the invention according to claims is not to be limited to the embodiments. Further, please note that all combinations of the features described in the embodiments are not necessary to solve the problem of the invention. The invention can be appropriately modified and implemented without departing from the gist thereof.

What is claimed is:

1. A window regulator, comprising:

a metal guide rail provided along an ascending/descending direction of a window of a vehicle;

a carrier plate that slides on the guide rail and moves together with the window;

a drum rotationally driven by a motor;

a cable that is routed between the drum and the carrier plate via a direction changing member provided at an upper end of the guide rail and pulls the carrier plate; and a cable support that supports the cable between the drum and the direction changing member, wherein the cable support comprises a resin slide member allowing the cable to slide thereon and an attached-member receiving portion to which the slide member is attached, wherein the attached-member receiving portion is integrated with the guide rail, and wherein the guide rail comprises a flat plate portion extending in a longitudinal direction of the guide rail and a pair of side plate portions rising upright from end portions of the flat plate portion, the end portions in a direction orthogonal to the longitudinal direction, and the attached-member receiving portion serving as part of the cable support comprises a plate-shaped mounting portion and plate-shaped fitting portions, the mounting portion being provided on one of the pair of side plate portions that is not the side plate portion slidably supporting the carrier plate, the mounting portion projecting from the end portion of the flat plate portion in a direction orthogonal to the longitudinal direction and comprising a mounting surface for mounting the slide member, and the fitting portions rising upright from an outer edge of the mounting portion and being fitted to fitting grooves formed on the slide member.

2. The window regulator according to claim 1, wherein the attached-member receiving portion serving as part of the cable support is provided at a longitudinal middle portion of the guide rail.

3. The window regulator according to claim 1, wherein the attached-member receiving portion serving as part of the cable support comprises curved portions that are arranged at both end portions in the longitudinal direction of the mounting portion and are formed to curve while protruding in the plate thickness direction of the mounting portion.

4. A window regulator, comprising:

a metal guide rail provided along an ascending/descending direction of a window of a vehicle;

a carrier plate that slides on the guide rail and moves together with the window;

a drum rotationally driven by a motor;

a cable that is routed between the drum and the carrier plate via a direction changing member provided at an upper end of the guide rail and pulls the carrier plate; and a cable support that supports the cable between the drum and the direction changing member, wherein the cable support comprises a resin slide member allowing the cable to slide thereon and an attached-member receiving portion to which the slide member is attached, wherein the attached-member receiving portion is integrated with the guide rail, and wherein the guide rail comprises a flat plate portion extending in a longitudinal direction of the guide rail and a pair of side plate portions rising upright from end portions of the flat plate portion, the end portions in a direction orthogonal to the longitudinal direction, and the attached-member receiving portion serving as part of the cable support comprises a plate-shaped mounting portion and locking holes, the mounting portion being provided on one of the pair of side plate portions that is not the side plate portion slidably supporting the carrier plate, the mounting portion projecting from the end portion of the flat plate portion in a direction orthogonal to the longitudinal direction and comprising a mounting surface for mounting the slide member, and the locking holes penetrating the mounting portion in a plate thickness direction and engaging locking portions formed on the slide member.

5. The window regulator according to claim 4, wherein the attached-member receiving portion serving as part of the cable support is provided at a longitudinal middle portion of the guide rail.

6. The window regulator according to claim 4, wherein the attached-member receiving portion serving as part of the cable support comprises curved portions that are arranged at both end portions in the longitudinal direction of the mounting portion and are formed to curve while protruding in the plate thickness direction of the mounting portion.

* * * * *